US007766019B2

(12) United States Patent
Luzenberg, Jr.

(10) Patent No.: US 7,766,019 B2
(45) Date of Patent: Aug. 3, 2010

(54) POROUS PLASTIC SMOKING CESSATION DEVICES

(75) Inventor: Robert S. Luzenberg, Jr., Birmingham, AL (US)

(73) Assignee: GP Technologies, Inc., Tampa, FL (US)

( * ) Notice: Subject to any disclaimer, the term of this patent is extended or adjusted under 35 U.S.C. 154(b) by 854 days.

(21) Appl. No.: 11/491,421

(22) Filed: Jul. 21, 2006

(65) Prior Publication Data

US 2008/0021072 A1 Jan. 24, 2008

(51) Int. Cl.
*A24F 47/00* (2006.01)

(52) U.S. Cl. ..... 131/273; 131/331; 131/332; 131/335; 131/270; 131/343; 514/343; 514/729; 514/725

(58) Field of Classification Search ..... None
See application file for complete search history.

(56) References Cited

U.S. PATENT DOCUMENTS

| | | | | |
|---|---|---|---|---|
| 1,059,693 | A | 4/1913 | Woods | |
| 1,534,339 | A | 4/1925 | Perry | |
| 1,792,430 | A | 2/1931 | Kruggely | |
| 1,938,384 | A | 12/1933 | Hauch | |
| 1,999,554 | A | 4/1935 | Zucker | |
| 2,202,796 | A | 5/1940 | Hermani | |
| 2,365,185 | A | 12/1944 | Gailey | |
| 2,680,048 | A | 6/1954 | McDonald | |
| 2,819,135 | A | 1/1958 | Shapiro | |
| 3,336,093 | A | 8/1967 | Phelps | |
| 3,801,011 | A | 4/1974 | Guehler et al. | |
| 4,008,930 | A | 2/1977 | Swainson | |
| 4,606,357 | A | 8/1986 | Dusek et al. | |
| 4,793,366 | A | 12/1988 | Hill | |
| 4,800,903 | A * | 1/1989 | Ray et al. | 131/273 |
| 4,907,605 | A | 3/1990 | Ray et al. | |
| 4,967,772 | A | 11/1990 | Waddell et al. | |
| 4,997,082 | A | 3/1991 | Durocher | |
| 5,042,510 | A | 8/1991 | Curtiss et al. | |
| 5,556,579 | A | 9/1996 | Newman | |
| 5,752,599 | A | 5/1998 | Veltman | |
| 5,824,334 | A | 10/1998 | Stanley et al. | |
| 6,024,012 | A | 2/2000 | Luzenberg, Jr. | |
| 6,027,187 | A | 2/2000 | Siepmann | |
| 6,041,789 | A | 3/2000 | Bankert et al. | |
| 6,162,516 | A | 12/2000 | Derr | |
| 6,541,055 | B1 | 4/2003 | Luzenberg, Jr. | |
| 6,845,777 | B2 | 1/2005 | Pera | |
| 2002/0059939 | A1 * | 5/2002 | Fox | 131/271 |
| 2004/0094170 | A1 * | 5/2004 | Zho et al. | 131/359 |
| 2004/0191322 | A1 | 9/2004 | Hansson | |
| 2005/0058609 | A1 | 3/2005 | Nazeri | |
| 2005/0061339 | A1 | 3/2005 | Hansson et al. | |
| 2007/0186942 | A1 | 8/2007 | Strickland et al. | |

* cited by examiner

*Primary Examiner*—Philip C Tucker
*Assistant Examiner*—Phu H Nguyen
(74) *Attorney, Agent, or Firm*—Krieg DeVault LLP

(57) ABSTRACT

A smoking cessation device is provided. The smoking cessation device includes a dispensing member comprising porous plastic defining a matrix of an internal network of passages in communication with pores on the exterior of the device. The device is preferably sized and structured like a cigarette or other combustible smoking device. Residing within the matrix is a dispensate extractable therefrom upon exposure to a fluid. In one form the dispensate may be a tobacco derivative including one or more of nicotine, tobacco flavoring, menthol, vitamins, minerals, therapeutic agents, and/or additional flavoring.

39 Claims, 4 Drawing Sheets

POROUS PLASTIC SMOKING CESSATION DEVICES

BACKGROUND

The present invention relates to a smoking cessation device and a manner of using the same, and more particularly, but not exclusively, relates to the use of porous plastic to deliver imitative characteristics of a combustible tobacco smoking article such as, for example, a cigarette.

The use of smoking cessation devices to address addiction to harmful tobacco products has become commonplace. In this arena, it is often desired to improve the independence of a user from smoking products, increase the realness of the devices, and ultimately provide more positive user outcomes. Unfortunately, current smoking cessation devices can be prone to failure. Thus, there is a need for additional contributions in this area of technology.

SUMMARY

One aspect of the present application is a unique smoking cessation device. Other aspects include unique methods, systems, devices, instrumentation, and apparatus involving a smoking cessation device.

In one aspect there is provided a smoking cessation device including a stock member and a dispensing member, wherein the stock member and the dispensing member are engageable to create a device sized and structured like a cigarette. The dispensing member comprises porous plastic defining a matrix including an internal network of passages and pores on an exposed surface of the dispensing member wherein the pores are in fluid communication with the internal network of passages of the matrix. Further provided in the smoking cessation device is a dispensate residing within the passages of the matrix which is extractable therefrom upon exposure to a fluid.

In a further aspect, there is provided a smoking cessation device including a dispensing member. The dispensing member comprises porous plastic including a matrix defining an internal network of passages in communication with a number of pores disposed on the external surface of the matrix. The device further includes a tobacco substitute wherein the tobacco substitute is passively retained in the passages of the matrix and is removable therefrom upon exposure to a fluid.

Yet another embodiment of the present invention includes a smoking cessation device comprising a dispensing member defining an elongate body extending between a first end and a second end. The dispensing member comprises porous plastic defining a network of passages in fluid communication with pores on the exterior of the body. An internal passageway extending axially through the elongate body further defines the dispensing member and is structured to facilitate airflow through the device. The smoking cessation device further includes a regulator engaged with the dispensing member and a dispensate which is passively retained in the network of passages of the dispensing member. The dispensate is extractable from the dispensing member upon exposure to a fluid.

Further embodiments, forms, features, aspects, benefits, objects, and advantages of the present application shall become apparent from the detailed description and figures provided herewith.

DETAILED DESCRIPTION OF SELECTED EMBODIMENTS

Figure 1:
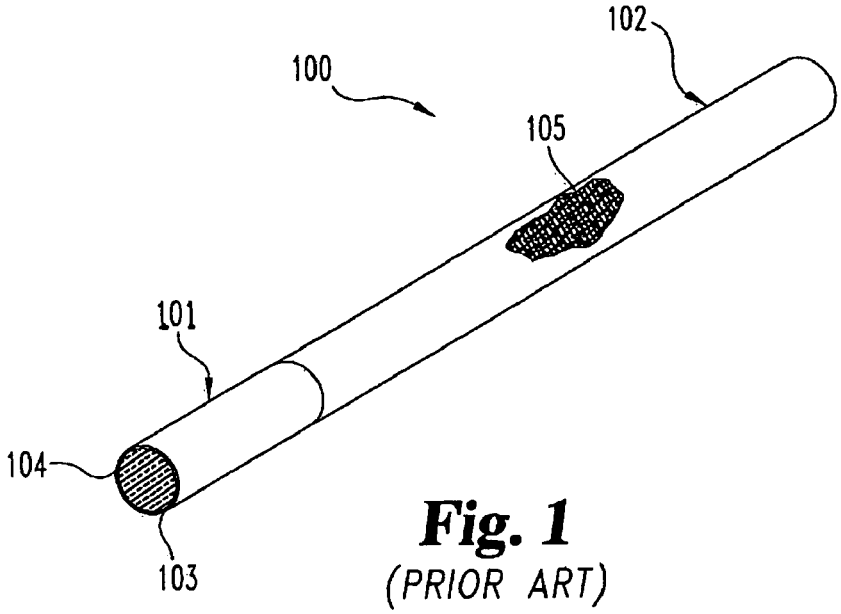
Fig. 1 (PRIOR ART)
FIG. 1 is a partial cutaway perspective view of a prior art combustible smoking device.

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

Smoking cessation devices are provided that include a body formed at least in part by a porous plastic material. The porous plastic material includes a matrix of passages in communication with pores on the exterior of the porous plastic body. A dispensate resides in the passages of the matrix and is extractable therefrom upon interaction with an extraction force. The extraction force can result from contact with a fluid, which may be, for example air or a liquid, such as an aqueous liquid. It is contemplated that the dispensate may be a tobacco substitute including tobacco flavorings, nicotine, menthol, and/or other additives as provided herein. It is further contemplated that the smoking cessation devices can be sized and structured to visually resemble and potentially have other physical properties of cigarettes, or may be formed to have features in common with other smoking devices such as for example, cigars, cloves, or pipes.

Referring now to FIG. 1, there is provided in partial cutaway perspective view a prior art cigarette 100. In this form, cigarette 100 includes a filter member 101 and a tobacco portion 102. Each of the filter member 101 and tobacco portion 102 may be surrounded by a cover 103. In one embodiment, cover 103 is of a single composition, for example, a combustible paper, while in another embodiment, cover 103 is composed of one material surrounding the filter member 101 and a different material surrounding tobacco portion 102. Tobacco portion 102 includes compacted tobacco 105 and may include additives such as flavorings and menthol, amongst many other variations. Filter member 101 includes filter 104 which is structured to collect certain by-products, like for example tar, from smoke produced upon combustion of tobacco portion 102. Cigarette 100 is produced commercially and is available from many manufacturers. It should be further understood that in alternative embodiments not shown combustible smoking device 100 may not include filter member 101, as in for example a filterless cigarette or a cigar. Additionally, tobacco portion 102 may be composed differently in alternative embodiments and may or may not include certain additives. It is further contemplated that smoking device may be in the form of a tobacco pipe or any other device providing tobacco combustion and smoke inhalation, as would be appreciated by one having skill in the art.

Figure 2:
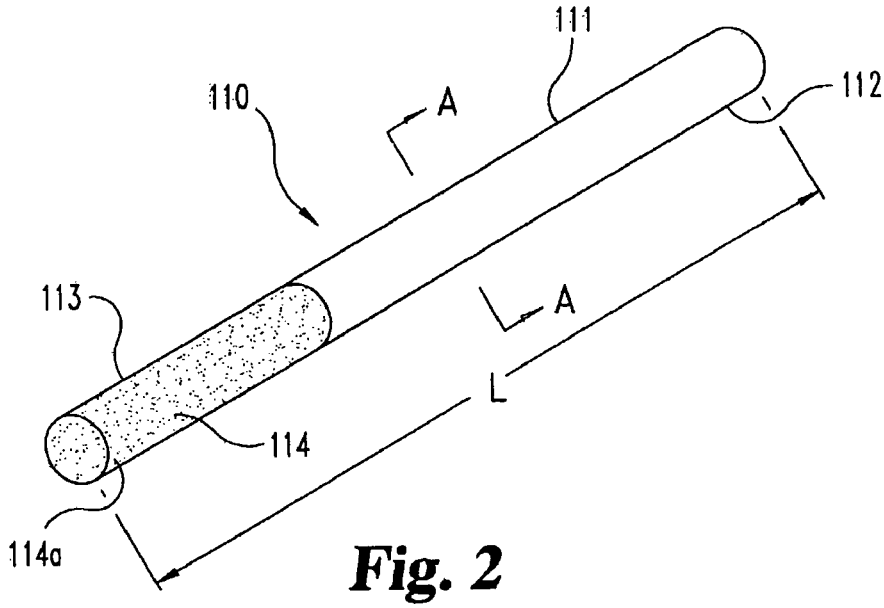
FIG. 2 is a perspective view of one embodiment of a porous plastic smoking cessation device in accordance with the invention.

FIG. 2 provides a perspective view of smoking cessation device 110. Device 110 includes a stock member 111 adjacent a dispensing member 113. Dispensing member 113 of device 110 comprises porous plastic including a matrix defining an internal network of passages in communication with pores 114 on external surface 114*a*. The matrix includes some form of a tobacco-like dispensate, such as, for example, nicotine and/or tobacco flavoring, as will be described herein, which is extractable from the matrix upon contact with a fluid, like for example, human saliva or a stream of air. As such, in one embodiment when dispensing member 113 is placed into a user's mouth, saliva comes into contact with pores 114 in external surface 114*a* and the dispensate is extracted, bringing the extracted dispensate into contact with taste receptors and mucosal membranes and/or digestive organs to satisfy a taste expectation and possibly to transfer a bio-absorbable ingredient of the dispensate into a user's bloodstream to satisfy a craving, such as, for example, a craving for nicotine.

A dispensing member of a smoking cessation device of the present invention comprises porous plastic that provides a matrix defining an internal network of passages. The matrix further comprises "pores" which pass through its exposed surfaces in fluid communication with the internal passages and also with the article's environment. As used herein, the term "exposed surface" is intended to refer to a surface of the porous plastic member with which a fluid comes into contact. Stated alternatively, an exposed surface is defined with respect to a smoking cessation device's macrostructure as a surface which defines the shape of the device and which generally defines the boundary between the device and its environment, whether or not the surface is visible from a point external of the device.

An "internal passage" or an "internal network of passages" refers to the compositional microstructure of the porous plastic matrix, and refers to spaces defined internally, i.e., within the porous plastic matrix. An internal passage is distinct for purposes of describing the present device from a recess or an aperture defined by the device. As will be understood by a person skilled in the relevant art, characteristics of internal passages may be modified by varying molding parameters when making the porous plastic article, such as, for example, the size of granule materials used to make the porous plastic matrix and/or the temperature and/or the pressure used in a molding process for making the article.

A device is prepared in accordance with the present application such that a porous plastic matrix, having a network of internal, interconnected passages therein, holds a dispensate material until an extraction force is exerted on the dispensing member 113, such as, for example, a wicking force exerted by a fluid that is in contact with an exposed surface of the matrix, at which time the dispensate material passes through the surface of the article and into the fluid.

In one aspect of the invention, the dispensate is a solid material. In one corresponding manner of making a matrix in accordance with the invention, a granular thermoplastic polymer is mixed with a dry water-soluble or water-dispersible powder and the mixture is then molded at a predetermined temperature and pressure. As used herein, the term "powder," is intended to refer to a substantially dry, particulate solid material. In an alternate aspect of the invention, the dispensate material selected to be dispensed using an inventive dispensing article is a liquid. In this aspect of the application, a matrix may be made by mixing the liquid dispensate material with thermoplastic polymer granules prior to molding, as described above, or a granular thermoplastic polymer may be molded in the absence of a dispensate material and the liquid dispensate is then introduced into the internal passages. The polymer may be one of a wide variety of thermoplastic polymers available commercially; however, as the polymer is intended to come into contact with humans, it is understood that the polymer is preferably one which satisfies relevant safety requirements.

A wide variety of molding techniques may be used in accordance with inventive methods, such techniques being known in the art. While it is not intended that the present application be limited by any theory by which it achieves its advantageous result, it is believed that, as the polymer granules are heated, the outer surfaces thereof become softened or tacky. When this occurs, pressure exerted upon the mixture causes the polymer granules to contact one another and adhere together. Thereafter, when the article cools, the points of contact become relatively strong points of adhesion, thus providing a relatively strong composite which is resistant to dusting, crumbling and breaking in the course of normal usage.

It is understood that a wide variety of material specifications (such as polymer type, polymer size, granule size distribution, dispensate powder type, dispensate powder particle size distribution and ratio of polymer to dispensate) and also a wide variety of process parameters (such as temperature and pressure) may be used in accordance with this application to provide porous plastic matrixes having various advantageous characteristics. For example, porous plastic matrixes may be made in accordance with the application that have differing rates of introduction of dispensates into a fluid. These rates of introduction are believed to be dependent in part upon the dimensions of the internal passages and pores, which may be controlled by varying the material specifications and process parameters described herein. It is within the ability of a skilled artisan, armed with the description of the present invention, to select, without undue experimentation, advantageous combinations of materials and parameters in accordance with the invention to provide articles having differing rates of dispensate release.

To provide porous plastic matrixes in accordance with the invention having differing dispensate-release characteristics, articles are made in which the overall volume of the internal passages differ (thereby varying the amount of dispensate that the matrix holds) and/or in which the dimensions of the internal passages and the pores differ (thereby varying the rate at which the dispensate passes from the matrix into a fluid). Dimensions of the internal structure of the matrix may be varied, for example, by selecting thermoplastic polymer granules having larger or smaller granular sizes, by adjusting the process temperature or process pressure at which inventive articles are molded, and/or by varying the ratio of polymer granules to dispensate powder in a mixture to be molded into an inventive article. Additionally, it is understood by a skilled artisan that different thermoplastic polymers or polymers having different molecular weights typically have different melting and solidifying characteristics. Therefore, it is within the purview of a skilled artisan to select a polymer suitable for a given application. In this regard, a number of companies presently produce porous plastic articles, such as, for example, MicoPore Plastics, Inc. (Tucker, Ga.); Porex Technologies Corp. (Fairburn, Ga.); Gen Pore, Inc. (Redding, Pa.);

and Innerflow, Inc. (New York, N.Y.). It is within the skill of employees of these companies to vary dispensing characteristics in accordance with the invention without undue experimentation.

In one embodiment, thermoplastic polymer granules used to make the porous plastic matrix preferably have a size distribution wherein at least about 90% of the granules are between about 30 and about 120 mesh. In another preferred embodiment, at least about 90% of the granules are between about 50 and about 100 mesh, and in yet another preferred embodiment, about 90% are between about 50 and about 70 mesh. It is understood that, where it is desired that the dispensate be released relatively quickly from an inventive article, a larger granule size may preferably be selected and, where it is desired that the dispensate be dispensed more slowly, a smaller granule size may preferably be selected.

In making a dispensing article in accordance with one aspect of the application, the mixture of polymer granules and dispensate to be molded preferably has a polymer:dispensate ratio of from about 6:4 to about 9:1 by weight, more preferably from about 7:3 to about 8:2 by weight. The preferred ratio, however, will depend upon the specific starting materials selected for use and the size distributions thereof (or physical characteristics where the dispensate is a liquid).

It is important in manufacturing methods that the polymer granules are present in sufficient quantity that, upon application of pressure, substantially every granule is in contact with at least two other granules, and preferably with three or more other granules. When the temperature of the mixture is raised to a satisfactory level for molding in accordance with the application, and the outer surfaces of the polymer granules are softened to a tacky state, the points of contact between granules provide points of adhesion. Upon subsequent cooling of the matrix, the points of adhesion become strengthened to provide a relatively strong bond. Thus, where the ratio of polymer granules to dispensate particles is sufficiently high, there exist sufficient points of contact to provide an article having good tensile strength and powdering/crumbling resistance. It is understood that a matrix molded using a mixture having an excessive proportion of dispensate therein may have an unsatisfactory tensile strength, or may fail to form at all.

It is also understood that a polymer granule to dispensate particle ratio which is relatively high will result in a matrix which releases dispensate into a fluid relatively slowly and in a relatively small overall quantity. In certain aspects of the application, such as, for example, where a slow rate of dispersement of dispensate from the matrix, a high polymer:dispensate ratio will be preferred. In alternate embodiments, however, where, for example, a higher dispensate concentration is desired, a lower polymer:dispensate ratio is preferred, within a desired range for making a sufficiently strong dispensing article.

It is important in the practice of the application to avoid a molding temperature or pressure which is too high or too low. In the case of the former (i.e., excessive temperature and/or pressure), the matrix may become overly compacted, thereby causing the polymer to encase the dispensate, resulting in an article which resembles a solid block. This phenomenon is believed to impair or destroy the interconnected internal network of passages and eliminate the dispensing function of the matrix. Where the temperature and/or pressure is too low, the resulting molded matrix may not have adequate tensile strength and, therefore, may have a tendency to crumble or break apart.

For purposes of efficiency in making the porous plastic matrix, it is preferred that the polymer selected for use in accordance with the application have a melting temperature of from about 115° F. to about 415° F., or more preferably from about 190° F. to about 340° F., and most preferably from about 240° F. to about 290° F. In accordance with one preferred aspect of the application, the thermoplastic polymer used to make a matrix is polyethylene. A polyethylene material which may advantageously be used in accordance with the application is HOLTALEN GHR 8020, which is commercially available from Hoechst AG, Werk Ruhrchemie, D-46128 Oberhausen. Where it is desired that the dispensate be dispensed relatively quickly from the porous plastic member, a lower temperature and/or pressure may preferably be selected in the molding process. In contrast, where it is desired that the dispensate be dispensed more slowly, a higher temperature and/or pressure may preferably be selected. The use of other advantageous thermoplastic polymers, such as, for example, polypropylene, may result in a different preferred range of temperatures and pressures. It is within the purview of a skilled artisan to determine the preferred ranges of temperature and pressure for a given thermoplastic polymer based upon the principles of the application.

A matrix that comprises a liquid dispensate held within the internal network of passages defined by a porous plastic matrix may alternatively be made by first forming a porous plastic matrix, and then introducing a liquid dispensate into the internal network of passages to provide a dispensing article. To make the porous plastic matrix, a granular thermoplastic polymer is first molded into a desired shape as described above but in the absence of a dispensate material. A liquid dispensate may then be introduced into the internal passages of the formed matrix, for example, by placing the matrix in a substantial vacuum and then immersing the matrix in the liquid dispensate so that the dispensate flows through the pores and into the internal network of passages. Having introduced the liquid dispensate into the matrix in this manner, the matrix may then be advantageously used as described herein to dispense the liquid into a fluid that comes into contact with the article. It is also understood that a matrix that has become spent, i.e., in which the dispensate has been exhausted, may advantageously be recharged with a liquid dispensate as described. Normal usage of the matrix does not substantially alter the advantageous internal structure of the dispensing member.

In an exemplary form, it is generally desired that the dispensate include features which imitate the characteristics of cigarettes. For example, the dispensate may include nicotine, tobacco flavoring, menthol, and/or other additives which are commonly found in tobacco products. Furthermore, the dispensate can optionally include additional ingredients that are not typically found in tobacco products, such as, for example, vitamins, minerals and caffeine.

When in a liquid form, the dispensate can be composed of, for example, an aqueous liquid, an alcohol, oil or combinations thereof. In one particularly preferred embodiment, the dispensate composition is composed primarily of oil. When a porous plastic article is made using conventional porous plastic manufacturing processes, the article will typically have a hydrophobic nature at the completion of the molding operation. Without requiring any further processing, such an article is operable to soak oil or other hydrophobic liquid into its internal passages through its pores. Thus, in one preferred embodiment of the invention, the dispensate is composed primarily of oil, having one or more tobacco-derived or tobacco-imitating ingredients entrained therein, and the porous plastic dispensing article is made by introducing the oil-based dispensate therein after a molding operation.

In other aspects of the invention, a porous plastic article can be further treated after a molding operation to alter the hydrophobic characteristic. For example, ion bombardment processes can be used to make such an article hydrophilic. In other aspects of the invention, the dispensate can be composed primarily of water having one or more tobacco-derived or tobacco-imitating ingredients entrained therein, and the porous plastic dispensing article can be made by introducing the water-based dispensate therein after a molding operation and ion bombardment processing.

The concentration levels of tobacco related products, such as flavoring, nicotine, and/or menthol, in the dispensate may vary in alternative embodiments. When created across multiple levels of concentration, the dispensate may be provided to gradually decrease a user's dependency on, for example nicotine, when on a smoking cessation program. For example, at the beginning of the program, the user might desire a high concentration of nicotine, while at a later stage of the program, the concentration of the nicotine may lowered to reflect a user's craving. Moreover, the dispensate may include one or more therapeutic agents, such as for example, an agent structured to lower a user's dependency on nicotine. Additionally, and/or alternatively, an agent structured to relieve pain, such as ibuprofen, may be included. When included, the concentrated levels of the therapeutic agents should be at a desired therapeutic dosage. Additionally, the dispensate may be created to comprise more or less of a certain therapeutic agent, so as to provide a variety of selections for a human user. The invention also contemplates that dispensates of different composition can be used in different portions of dispensing member 113 or device 110 (in embodiments in which stock member 111 is also part of dispensing member 113). For example, a dispensate including nicotine could be located in one portion of the device and a dispensate including a flavoring material and/or a therapeutic agent could be located in another portion of the device. This arrangement provides increased flexibility in the manufacture of devices having a variety of flavors, therapeutic agents or other features.

In an embodiment in which a liquid dispensate is used, the dispensate can be an extract from tobacco leaves. One method that can be used to provide a liquid extract is set forth in U.S. Pat. No. 4,606,357 to Dusek et al., which is herein incorporated by its entirety. Additionally, the dispensate in a powder form may be produced in any number of methods as would be appreciated to one having ordinary skill in the art. U.S. Pat. No. 6,845,777 to Pera, which is herein incorporated by reference, is directed to one method of creating a powder including tobacco properties of which can be used as a dispensate in the current application. It is further contemplated that the dispensate may be provided in a crystallized form.

Stock member 111 may include various structural features in different embodiments. In certain embodiments, stock member 111 may be wholly or partially solid. In one embodiment where stock member 111 is at least only partially solid, it may be structured like a tube and external surface 112 may include one or more apertures extending therethrough to contact a hollow interior. In one embodiment, it will be desired that stock member 111 is structured such that stock member 111 as a whole replicates the weight of tobacco portion 102 of cigarette 100. The actual size of stock member 111 may be dependent upon the size of dispensing member 113 and may be adjusted in proportion to member 113 such that device 110 is sized and shaped like a cigarette. Furthermore, stock member 111 may be composed of certain polymers, metals, ceramics, or any combination thereof, just to name a few possibilities, so long as the material selected is safe for the intended use and preferably capable of providing an entire device 110 having overall characteristics similar to that of cigarette 100.

Dispensing member 113 and stock member 111 may be engaged with one another through various means. For example, in an embodiment not shown, dispensing member 113 includes a section having external threads while stock member 111 includes corresponding internal threading such that when dispensing member 113 is rotated it threadingly engages with stock member 111. In alternative embodiments, stock member 111 and dispensing member 113 may be connected through other mechanical connections including press fit, clamping, pinning, fusing and/or gluing. It should be understood that in embodiments wherein stock member 111 and dispensing member 113 are releasably connected, additional dispensing members may be provided as replacements for a dispensing member that has become exhausted.

In a preferred embodiment, the length L of device 110 is selected, and the device is otherwise sized and shaped, to resemble the corresponding size and shape of a desired combustible smoking device. For example, length L may be sized to resemble the length of a corresponding cigarette, cigar, or clove, just to name a few possibilities. Furthermore, in the illustrated embodiment, device 110 has a substantially circular cross section to resemble the cross sectional profile of certain combustible smoking devices. It should be understood that device 110 and the other devices contemplated by the present application may have an alternative cross section configuration. For example, any of the devices may include a triangular, rectangular, hexagonal, or octagonal cross sectional profile.

Figure 3:
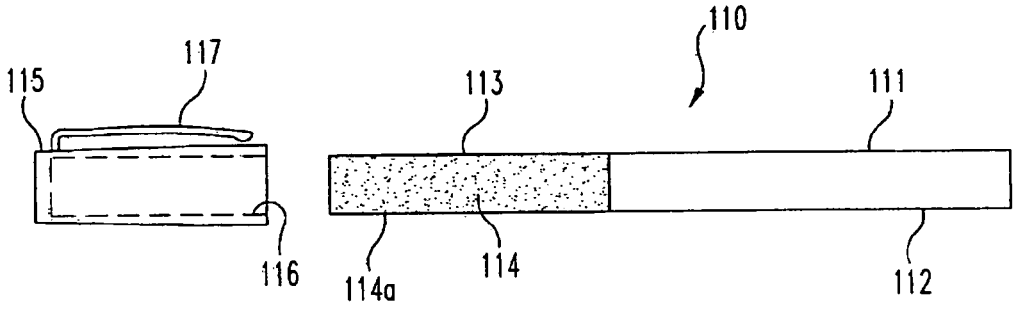
FIG. 3 is a plan view of the porous plastic smoking cessation device of FIG. 2 further including a cap member.

In certain embodiments, it is desired to provide a covering to prevent dispensate from exiting the dispensing member 113 while device 110 is not in use. One such covering in the form of a cap 115 is illustrated in conjunction with device 110 in side plan view in FIG. 3. Cap 115 includes an internal passage 116 which is structured to received, and optionally to correspondingly mate with, external surface 114*a* of dispensing member 113. As such, cap 115 may be connected with device 110 to cover dispensing member 113 while not in use to prevent the escape of dispensate therefrom. Cap 115 may be engageable with device 110 through various ways, including but not limited to, a snap fit, a press fit, or a threaded interconnection. Clip 117 may be included on cap 115 such that cap 115 either singly or in combination with device 110 may be clipped onto, for example, a user's pocket, a belt, a car visor, or a cup, just to name a few possibilities. While shown in conjunction with device 110, it should be understood that cap 115 may be structured for engagement with any of the devices illustrated and contemplated herein.

Cap 115 may be used in conjunction with device 110 when stock member 111 has either an open or solid interior. In alternative embodiments, rather than covering dispensing member 113 with a cap, dispensing member 113 can be provided in a retractable form when stock member 111 is tube-shaped, and has an open interior. One such embodiment is shown as device 120 in perspective view in FIG. 4. Device 120 includes tubular member 121 and dispensing member 123 with pores 124, wherein dispensing member 123 comprises porous plastic and a dispensate therein according to embodiments described herein. As illustrated, dispensing member 123 is formed to fit within, and is optionally engageable with, an open interior 122 of tubular member 121. It should be understood that the exterior surface 124*a* of member 123 can have a diameter substantially similar to that of interior 122. When engaged, end portion 125 of member 123 may be moved proximally or distally to or from end 126 of tubular member 121 as indicated by directional arrow B, so as to control the exposure of pores 124 to a fluid.

Member 123 may be moved in relation to tubular member 121 along the path of directional arrow B through various means, for example, including but not limited to a press fit or a threaded interconnection. It should be further understood that member 123 may or may not be detachably engaged with stock member 121, such that in certain embodiments member 123 may be replaced when all of the dispensate has been extracted therefrom. In certain embodiments, only a portion of dispensing member 123 is exposed to a fluid, such as by placing member 123 in one's mouth, such that the dispensate may be controllably released according to a human craving by adjustably alternating the amount of external surface 124*a* which is exposed. Additionally, when not in use, a majority of or the entire length of member 123 may be enclosed by tubular member 121 to prohibit unintentional exposure of pores 124 to an external fluid.

Figure 4:
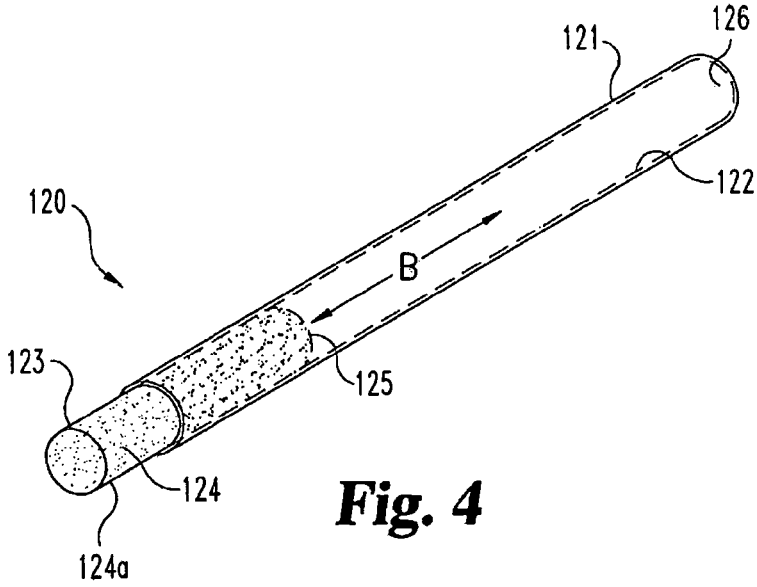
FIG. 4 is a perspective view of an adjustably exposable porous plastic smoking cessation device, with some features being shown in phantom.

In one preferred embodiment, which is a variation of the embodiment depicted in FIG. 4, dispensing member has a length greater than the length of tubular member 121. As will be appreciated by a person of ordinary skill in the art, tubular member 121 in such embodiment operates as a sleeve that can be slid to alternate positions in which it either covers or does not cover one or the other end portion of dispensing member. In a particularly preferred embodiment, dispensing member comprises a porous plastic rod having a length of about 3-5 inches, wherein an end portion thereof, such as a portion of at least about 1 inch in length, has a dispensate contained therein. Tubular member 121 in this embodiment is a clear plastic sleeve or a white plastic sleeve having a length of from about 1 to about 3 inches. The sleeve can optionally have an end portion of about 1 inch in length that is covered with a filter paper resembling the filter paper of a conventional filtered cigarette. When the sleeve is slid to a position in which dispensing member 123 is substantially covered, i.e., with the filter paper positioned at or near the end of dispensing member 123, the device bears a resemblance to a traditional filtered cigarette. The sleeve can then be slid away from the end to uncover the end portion of dispensing member 123 having dispensate contained therein, for use of the device, such as by placement of dispensing member 123 in a user's mouth. After use, the sleeve can be slid back toward the end of dispensing member 123 containing the dispensate until a subsequent use.

As an alternative to the use of a dispensing member having a length greater than the length of tubular member 121, a stock member can be connected to dispensing member 123 in a manner as described in connection with FIG. 2 such that the overall length of the dispensing member 113 and stock member 111 is greater than the length of tubular member 121. In this embodiment, tubular member 121 also operates as a sleeve that can be slid to alternate positions in which it either covers or does not cover dispensing member 123. Tubular member 121 in this embodiment can also be a clear plastic sleeve or a white plastic sleeve having a length of from about 1 to about 3 inches, and optionally having an end portion of about 1 inch in length that is covered with a filter paper resembling the filter paper of a conventional filtered cigarette. When the sleeve is slid to a position in which dispensing member 123 is substantially covered, i.e., with the filter paper positioned at or near the end of dispensing member, the device bears a resemblance to a traditional filtered cigarette. The sleeve can then be slid away from the end to uncover dispensing member 123 for use of the device.

Figure 5:
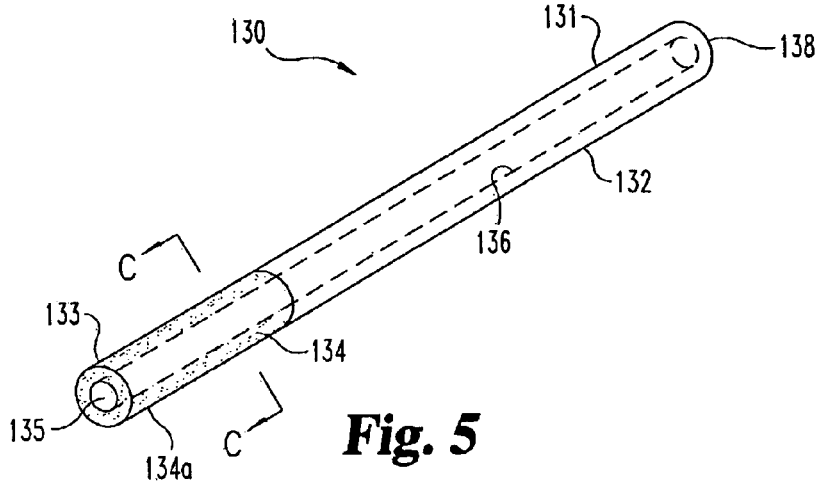
FIG. 5 is a perspective view of a porous plastic smoking cessation device including an internal channel for airflow.

An alternative embodiment of a smoking cessation device 130 is shown in perspective view in FIG. 5. Device 130 includes a stock member 131 including external surface 132 connected to a dispensing member 133 comprising porous plastic and including an external surface 134*a* with pores 134. Stock member 131 may be connected to dispensing member 133 according to connection means as already described herein. Member 133 includes a passageway 135 extending axially therethrough to communicate with a passageway 136 extending axially through stock member 131. As illustrated, passageway 136 extends through end 138 of stock member 131 such that a fluid stream may pass therethrough. In additional embodiments not shown, external surface 132 may include one or more apertures communicating with passageway 136 either singly or in combination with the opening at end 138.

Figure 6:
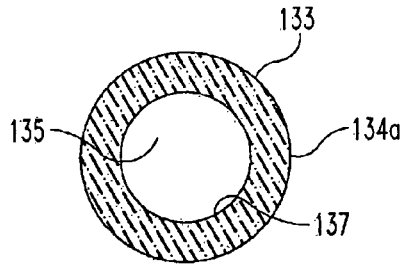
FIG. 6 is a cross sectional view of the porous plastic smoking cessation device of FIG. 5 viewed across view line C-C.

FIG. 6 illustrates a cross sectional view of dispensing member 133 of device 130 when viewed across view line C-C of FIG. 5. It should be understood that passageway 135 of member 133 includes a surface 137 including pores connected to the internal passages of the matrix, such that as surface 137 is exposed to a fluid the dispensate can be extracted therefrom. In one example, when a user has dispensing member 133 in his or her mouth and inhales, air is drawn into opening 138 of stock member 131 and passes through passageway 136 and passageway 135 to contact surface 137 including pores. The dispensate can be withdrawn from the matrix and drawn into the user's mouth, either by becoming entrained in the air stream or by flowing into the user's mouth through passageway 135.

Additionally, as illustrated, human saliva may come into contact with surface 137 and/or surface 134*a* further causing extraction of the dispensate from dispensing member 133. In alternative embodiments not shown, device 130 may not include pores 134 on external surface 134*a* such that the dispensate is extracted from member 133 only by exposure of surface 137 to a fluid. Furthermore, in certain embodiments not shown, passageway 135 may include a check valve disposed therein. The check valve is structured to be closed in an unbiased state to prevent saliva from contacting surface 137. In a biased state, upon inhalation or suction by a user, the check valve is forced open to allow air to pass through passageway 135 and extract the dispensate from surface 137 to be brought into the user's mouth. In this embodiment, the release of dispensate by device 130 is limited to inhalation or suction by the user. Device 130 may be sized and structured to correspond to the shape of a cigarette, as described herein.

Figure 7:
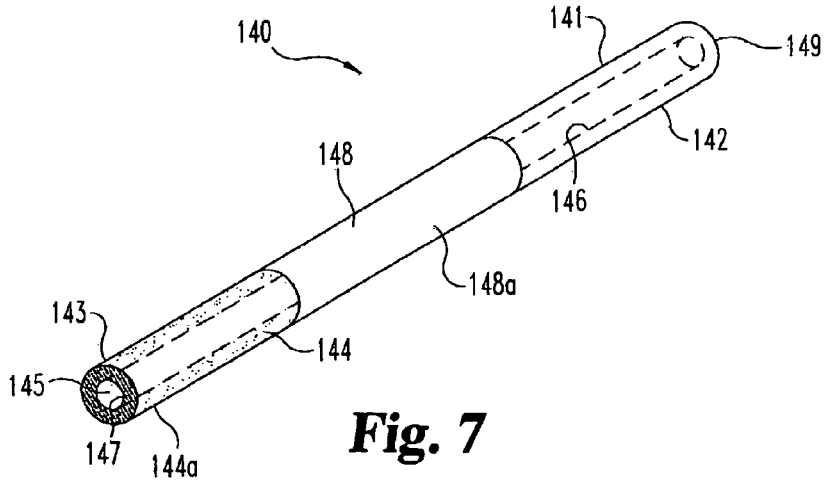
FIG. 7 is a perspective view of a porous plastic smoking cessation device including a regulator.

Referring now to FIG. 7 there is shown in perspective view an alternative smoking cessation device 140. Device 140 is similar to device 130 of FIG. 5 and the discussion regarding device 130 is considered relevant to the embodiment of FIG. 7. Device 140 includes a stock member 141 having an internal passageway 146 extending axially therethrough. Device 140 further includes a dispensing member 143 comprising porous plastic defining a matrix of internal passages in fluid communication with pores 144 on external surface 144*a*. Member 143 includes a passageway 145 extending axially therethrough with passageway 145 including a surface 147 having pores in communication with the internal passages of the matrix of member 143 such that the dispensate is releasable from surface 147 when contacted by a fluid.

As illustrated, a regulator 148 is disposed between stock member 141 and dispensing member 143. Regulator 148 is structured to at least partially restrict air flow through device 140. For example, in one embodiment, regulator 148 may be a filter 148*a* and include structural features similar to that of filter member 101 of device 100 such that when a user inhales through or applies suction to device 140, the restriction on airflow is similar to that encountered when smoking a cigarette. Therefore, air may be drawn into passageway 146 through end 149, passed through filter 148*a*, and then inhaled by the user in an action mimicking the inhalation of smoke from a cigarette during smoking. Dispensate can be delivered to the user in this embodiment via the flow of air that is brought into contact with surface 147 to extract dispensate from dispensing member 143. In this regard, the suction applied by the user will exert a force upon the liquid dispensate, urging it through pores in surface 147 and into passageway 145. Alternatively, the dispensate may be delivered to a user primarily or solely by wicking into the saliva of a user from surface 144*a* of member 143 rather than via surface 147. In either embodiment, the regulator serves an important function of providing a restriction to air flow that imparts cigarette-like features to the device. In alternative embodiments not shown, it is contemplated that end 149 may or may not be open and that air may be introduced to passage 146 through one or more apertures extending through exterior surface 142.

Figure 8:
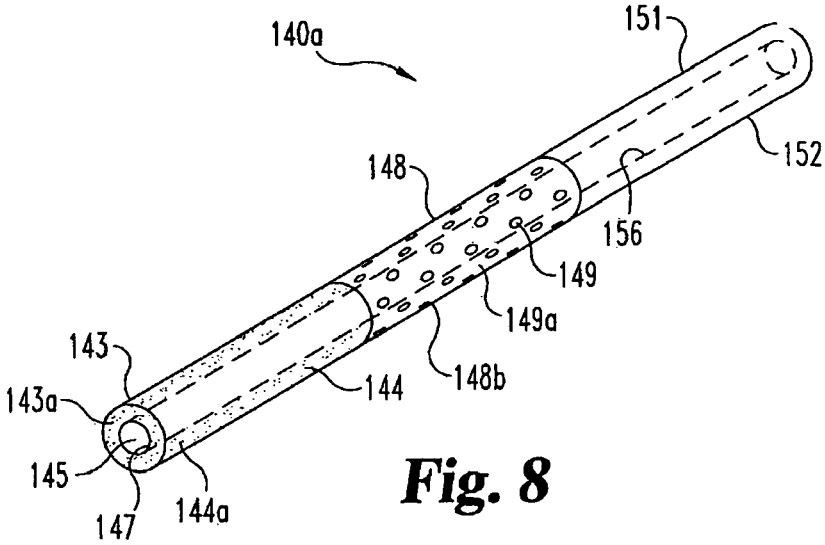
FIG. 8 is a perspective view of an alternative embodiment of a porous plastic smoking cessation device including a regulator.

An alternative embodiment of a smoking cessation device 140*a* including regulator 148 is shown in perspective view in FIG. 8, where like numerals refer to like features previously described. Disposed between members 151 and 143 is regulator 148 in the form of filter 148*b* formed of porous plastic and including pores 149 on external surface 149*a*. Regulator 148 in a porous plastic form may be produced in accordance with the procedures stated herein and may or may not include a dispensate. Porous plastic filter 148*b* is structured to restrict airflow as it passes through passageway 146 toward dispensing member 143, for example, to imitate the suction resistance of a cigarette.

In an embodiment not shown, stock member 141, 151 may not include passage 146, 156. In this embodiment, the porous plastic matrix of filter 148*b* is structured to permit the passage of airflow therethrough to come into contact with passageway 145 of member 143. In this embodiment, the structure of filter 148*b* is still such that airflow is restricted similar to the restriction produced by filter member 101 of combustible smoking device 100. In an additional embodiment not shown, passage 145 is absent from member 143 and the porous plastic matrix of member 143 is structured to channel airflow from filter 148*b* such that it exits device 140*a* carrying the dispensate at end 143*a*. As illustrated, saliva may also contact surface 147 and exterior surface 144*a* to facilitate extraction of the dispensate from the porous plastic matrix. In certain embodiments, saliva may enter through pores 144 on surface 144*a* and exit through surface 147 such that the saliva including the dispensate is passed into the user's mouth through passageway 145. Furthermore, while in the embodiments illustrated regulator 148 is shown disposed between dispensing member 143 and stock member 141, it is contemplated that regulator 148 may be located at end 149 so that stock member 141 and dispensing member 143 are adjacent each other.

Additionally, as illustrated, human saliva may come into contact with surface 147 and/or surface 144*a* further causing extraction of the dispensate from dispensing member 143. In alternative embodiments not shown, device 140 may not include pores 144 on external surface 144*a* such that the dispensate is extracted from dispensing member 143 only by exposure of surface 147 to a fluid. Furthermore, passageway 145 may include a check valve as described above to limit the manner in which the dispensate is withdrawn from dispensing member 143 to inhalation or suction only. Device 140 may be sized and structured to correspond to a cigarette as herein described with respect to device 110.

Figure 9:
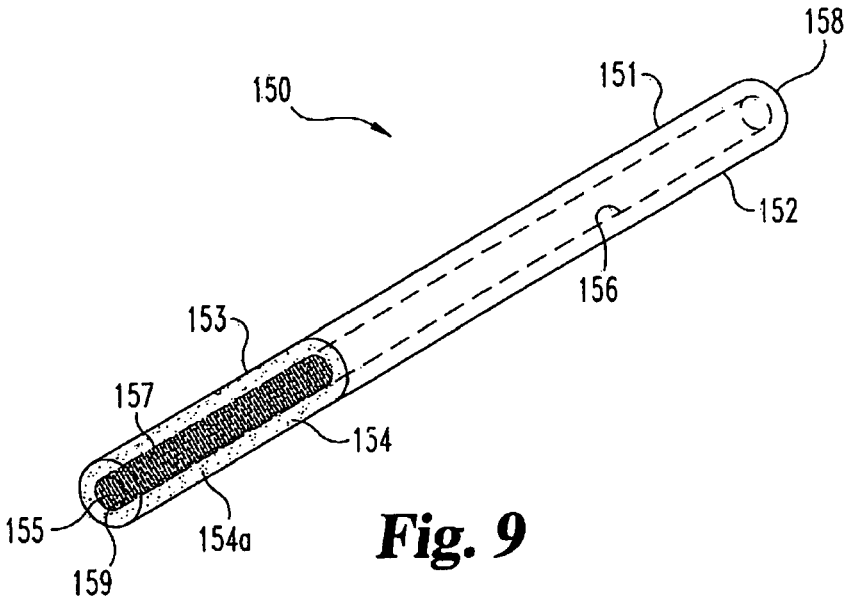
FIG. 9 is a perspective view of an additional alternative embodiment of a porous plastic smoking cessation device including a regulator.

Referring now to FIG. 9 there is shown in perspective view an additional embodiment of a filtered smoking cessation device 150. Device 150 includes a passageway 156 extending axially through stock member 151. While it is illustrated that passageway 156 extends through end 158 such that air may be brought into end 158, it is contemplated that exterior surface 152 may include one or more apertures extending therethrough to communicate with passage 156 to allow air passage therein. Adjacent to stock member 151 is a dispensing member 153 comprising porous plastic defining a matrix of internal passages and including an external surface 154*a* having pores 154. Member 153 further includes a passageway 155 extending axially therethrough to communicate with passageway 156 of stock member 151.

Disposed within passageway 155 is a regulator 157. Regulator 157 is structured to at least partially restrict airflow as it passes from end 158 to a point of suction or inhalation, which may be a user's mouth. In one embodiment, regulator 157 is structured to restrict airflow similar to that of filter member 101 of device 100. As such, regulator 157 may be of a material commonly used for commercial cigarette filters or it may be porous plastic, or any other composition useful for regulating the flow of air to mimic that of a cigarette filter. As illustrated, the dispensate may be extracted from exterior surface 154*a* upon exposure to a fluid, for example, such as saliva while a user may simultaneously inhale or take a "drag" from device 150. Furthermore, interior surface 159 may include pores in communication with the internal passages of the porous plastic matrix so that the dispensate may be released through surface 159. In these embodiments, regulator 157 is structured to permit passage of the dispensate therethrough to contact a human user to permit introduction of the dispensate to various receptor and absorption sites.

While the invention has been illustrated and described in detail in the drawings and foregoing description, the same is to be considered illustrative and not restrictive in character, it being understood that only selected embodiments have been shown and described and that all changes, equivalents, and modifications that come within the scope of the inventions described herein or defined by the following claims are desired to be protected. Any experiments, experimental examples, or experimental results provided herein are intended to be illustrative of the present invention and should not be construed to limit or restrict the invention scope. Further, any theory, mechanism of operation, proof, or finding stated herein is meant to further enhance understanding of the present invention and is not intended to limit the present invention in any way to such theory, mechanism of operation, proof, or finding. In reading the claims, words such as "a", "an", "at least on", and "at least a portion" are not intended to limit the claims to only one item unless specifically stated to the contrary. Further, when the language "at least a portion" and/or "a portion" is used, the claims may include a portion and/or the entire item unless specifically stated to the contrary.

What is claimed is:

1. A smoking cessation device, comprising:

an elongate body including a longitudinal external surface extending between a proximal end and a distal end, the elongate body further including:

a dispensing member comprising porous plastic and including a matrix defining an internal network of passages and defining pores on an exposed surface of the matrix in fluid communication with the passages;

a stock member structured to engage with the dispensing member such that the smoking cessation device has a size and structure corresponding to the shape of a cigarette; and a dispensate residing within the passages of the matrix which is extractable therefrom upon exposure to a fluid;

wherein the longitudinal external surface of the elongate body is partially defined by the exposed surface of said matrix.

2. The smoking cessation device of claim 1 further comprising an end cap, wherein the end cap is structured to cover an exposed portion of the dispensing member.

3. The smoking cessation device of claim 1 wherein the dispensing member is slidably retractable within the stock member to removably cover the pores of the dispensing member.

4. The smoking cessation device of claim 1 wherein the dispensate is a tobacco substitute.

5. The smoking cessation device of claim 4 wherein the dispensate is in a liquid form.

6. The smoking cessation device of claim 5 wherein the dispensate is extractable from the dispensing member upon contact with saliva.

7. The smoking cessation device of claim 4 wherein the dispensate is in a powder form.

8. The smoking cessation device of claim 7 wherein the dispensate is extractable from the dispensing member upon contact with saliva.

9. The smoking cessation device of claim 4 wherein the tobacco substitute comprises a tobacco extract.

10. The smoking cessation device of claim 9 wherein the tobacco extract includes an additive selected from the group consisting of: nicotine, menthol, flavoring, vitamins, minerals, and therapeutic agents.

11. The smoking cessation device of claim 9 wherein the tobacco extract is saliva soluble.

12. The smoking cessation device of claim 1 wherein the dispensing member further includes an airway extending axially therethrough and wherein pores adjacent the airway are in fluid communication with the passages of the matrix.

13. The smoking cessation device of claim 12 wherein the dispensate is extractable from the dispensing member upon passage of air through the airway.

14. The smoking cessation device of claim 13 wherein the dispensate is drawn from the porous plastic of the dispensing member toward a human mouth upon inhalation or suction.

15. The smoking cessation device of claim 12 further including a regulator, wherein the regulator is engageable with the dispensing member to at least partially restrict passage of air through the airway to limit the extraction of the dispensate from the dispensing member.

16. The smoking cessation device of claim 15 wherein the regulator is sized and structured for insertion into the passageway to restrict airflow.

17. The smoking cessation device of claim 15 wherein the regulator produces airflow restriction to impose upon a user the characteristics of a filtered cigarette.

18. The smoking cessation device of claim 1 wherein the matrix of the dispensing member is operable to wick a tobacco substitute toward a saliva source.

19. The smoking cessation device of claim 1 wherein the dispensate includes nicotine.

20. The smoking cessation device of claim 1 wherein the dispensate includes tobacco flavoring.

21. The smoking cessation device of claim 1 wherein the tobacco substitute includes menthol.

22. The smoking cessation device of claim 1 wherein the dispensate includes vitamin A.

23. The smoking cessation device of claim 1 wherein the dispensing member defines a passageway extending axially therethrough from a first end of the dispensing member to a second end of the dispensing member to permit airflow through the elongate body.

24. The smoking cessation device of claim 1, wherein the longitudinal external surface is further defined by the stock member.

25. The smoking cessation device of claim 1, wherein at least a portion of the dispensing member is positioned proximally of the stock member.

26. The smoking cessation device of claim 1, wherein the dispensing member extends proximally from a proximal end of the stock member.

27. A smoking cessation device comprising:

an elongate body including a longitudinal external surface extending between a first end and a second end; wherein the elongate body includes a dispensing member comprising porous plastic and including matrix defining an internal network of passages and defining pores on the longitudinal external surface in fluid communication with the passages; the elongate body further including:

an internal passageway extending axially along the elongate body from the first to second end to facilitate airflow therethrough;

a regulator engaged with the dispensing member; and a dispensate passively retained in the network of passages of the porous plastic and extractable from the porous plastic upon exposure to a fluid.

28. The smoking cessation device of claim 27 wherein the internal passageway further includes pores in communication with the network of passages.

29. The smoking cessation device of claim 28 wherein the dispensate is saliva-soluble and wherein contact with saliva extracts the dispensate from the exterior pores of the dispensing member and the internal passageway of the dispensing member.

30. The smoking cessation device of claim 29 wherein the dispensing member is structured to wick the dispensate through the network of passages toward a saliva source.

31. The smoking cessation device of claim 27 wherein the regulator limits air flow through the passageway in an amount such that the smoking cessation device impresses upon a user the characteristics of a filtered cigarette.

32. The smoking cessation device of claim 27 wherein inhalation by a user extracts the dispensate from the dispensing member.

33. The smoking cessation device of claim 27 wherein the dispensate is absorbable into the human blood system.

34. The smoking cessation device of claim 33 wherein the dispensate is absorbed by mucus membranes.

35. The smoking cessation device of claim 27 wherein the dispensate comprises a tobacco extract.

36. The smoking cessation device of claim 35 wherein the tobacco extract includes nicotine.

37. The smoking cessation device of claim 35 wherein the tobacco extract includes tobacco flavoring.

38. The smoking cessation device of claim 27 wherein the dispensate includes an additive selected from the group consisting of: vitamins, minerals, menthol, synthetic flavoring, nicotine, tobacco flavor, and therapeutic agents.

39. The smoking cessation device of claim 27, wherein the regulator is positioned in the internal passageway of the dispensing member.

* * * * *